United States Patent [19]

Yoho

[11] 4,066,244

[45] Jan. 3, 1978

[54] VEHICULAR ENERGY ABSORBER

[75] Inventor: Leland E. Yoho, Uniontown, Ohio

[73] Assignees: Glenn Fisher, Akron; Warren G. Yoho, Jacobsburg; Leland E. Yoho, Uniontown, all of Ohio ; part interest to each

[21] Appl. No.: 724,980

[22] Filed: Sept. 20, 1976

[51] Int. Cl.[2] ..... E04F 13/00

[52] U.S. Cl. ..... 256/1; 256/13.1; 404/6; 61/38

[58] Field of Search ..... 256/1, 13.1; 114/219; 61/3, 4, 5, 48, 37; 404/6, 7, 8, 9, 10

[56] References Cited

U.S. PATENT DOCUMENTS

| | | | |
|---|---|---|---|
| 3,276,210 | 10/1966 | Stitt | 61/5 |
| 3,357,192 | 12/1967 | Hibarger | 61/5 |
| 3,842,606 | 10/1974 | Stiles | 61/3 X |
| 3,845,936 | 11/1974 | Boedecker, Jr. | 256/13.1 X |
| 3,856,268 | 12/1974 | Fitch | 256/1 |
| 3,876,185 | 4/1975 | Welch | 256/1 |
| 3,951,384 | 4/1976 | Hildreth, Jr. | 256/1 |

*Primary Examiner*—Andrew V. Kundrat
*Attorney, Agent, or Firm*—Hamilton, Renner & Kenner

[57] ABSTRACT

Disclosed is a device for absorbing the energy of a vehicle and protecting the same in the event of a collision with a relatively immovable hazard along a highway such as a bridge abutment or the like. The device includes a network of toroidal members, such as tires, including at least two rows of upright tires and a line of tires between the row of tires. The rows of tires extend in a direction generally transverse to the expected direction of impact with the tires of the line of tires extending in a direction generally longitudinally of the expected direction of impact. A plurality of stanchions are preferably located generally between the first row of tires and the hazard. A cable or the like extends from each stanchion and through the tires in the rows of tires to hold them down. The tires in each row are connected to each other and to the tires in the lines of tires to form an integral network of tires to absorb the energy of the impact.

12 Claims, 2 Drawing Figures

VEHICULAR ENERGY ABSORBER

BACKGROUND OF THE INVENTION

This invention relates to a traffic barricade for placement adjacent a road hazard to absorb the impact of the collision of a moving vehicle with the hazard. More particularly, this invention relates to the use of moderately resilient toroidal members, such as tires, configured in a network to protect the vehicle and the operator thereof from serious damage.

With an ever increasing emphasis on traffic safety, numerous types of devices have been developed to provide a protective shield around permanent road hazards so that should a vehicle go out of control and into the direction of the hazard, damage to the vehicle, its occupants and the hazard itself will be kept at a minimum. The crudest of these devices is the common guard rail which, when placed adjacent a hazard, will tend to force the vehicle to glance back toward the road. However, it is well known that often, particularly at high speeds, vehicles may jump guard rails or break the same thereby limiting the effect thereof. In addition, not only can contact with the guard rail itself prove damaging to the vehicle and its operator, but also the glancing blow will often move a vehicle, now out of control, back into moving traffic.

As an alternative to the rigid guard rail, other types of more cushioned barricades have been developed. Some of these barricades utilize sand, liquid or gas filled structures which usually break upon impact in an attempt to cushion the force of the collision. Unfortunately these types of barricades tend to be expensive to manufacture, must be replaced after even small impacts, and often tend to be too resilient such that energy is transferred back to the vehicle rather than absorbed.

Because of the abundant availability of used vehicle tires with little uses for them and because of their moderately elastic nature, a number of barricades have been developed utilizing vehicle tires wich would otherwise be scrapped. One such device, as shown in Bruner, et al., U.S. Pat. No. 3,934,540, issued Jan. 27, 1976, utilizes vertically oriented tires partially embedded in reinforced concrete as a barrier. Another patent, Walker, U.S. Pat. No. 3,661,359, issued May 9, 1972, utilizes vertically oriented tires filled with a liquid such that the liquid will blow out upon impact. Such devices present problems in that the former will not sufficiently absorb the impact of the vehicle, being mounted in concrete, and the latter will not sufficiently absorb high speed collisions, there being a tendency for the vehicle to be severely damaged by the barricade itself and possibly continue moving through the diameter of the single tire to contact the hazard itself.

In order to provide a better clearance between the hazard and the point of impact, Hildreth, U.S. Pat. No. 3,951,384, issued Apr. 20, 1976, discloses a plurality of stacked tires lying on the ground in tangential contact. The tire stacks are filled with crushable containers to provide additional energy absorption. However, tires stacked in a fashion as taught by this patent provide a rather rigid barricade and one which can almost be as dangerous as the hazard itself because the force of the collision is absorbed in one direction only.

SUMMARY OF THE INVENTION

It is therefore a primary object of the present invention to provide an energy absorbing barricade for a road hazard which will prevent contact between a vehicle and the hazard with minimal damage to the vehicle or injury to the operator or passengers thereof.

It is another object of the present invention to provide a barricade, as above, in which the force of a collision is uniformly distributed throughout the barricade and therefore absorbed in multiple directions.

It is a further object of the present invention to provide a barricade, as above, which is constructed of a network of toroidal members, such as tires, and formed in such a manner so as to be sufficiently rigid and yet moderately resilient.

It is still another object of the present invention to provide a barricade, as above, which can readily be configured to conform with any shape or size of hazard.

It is yet another object of the present invention to provide a barricade, as above, which is inexpensive to construct, install and maintain, being made in its preferred form primarily from materials which would otherwise be scrapped.

These and other objects of the present invention, which will become apparent from the following description, are accomplished by the means hereinafter described and claimed.

In general, the device which absorbs the impact of a collision of a moving vehicle with a relatively stationary road hazard includes at least two rows of upright toroidal shaped members aligned in a direction generally transverse to the expected direction of impact and a line of toroidal shaped members between each row of toroidal shaped members, the toroidal members of the line extending in a direction generally longitudinally of the expected direction of impact. The first row of toroidal members is positioned generally adjacent the hazard with the last row in a position to receive the direct contact of the vehicle.

DESCRIPTION OF THE PREFERRED EMBODIMENT

The barricade designed to absorb the impact of a moving vehicle is indicated generally by the numeral 10 and shown positioned adjacent a schematically shown road hazard 11. Barricade 10 basically includes a network of toroidal members which conveniently and economically can be vehicle tires. While any other generally toroidal member having similar rigidity/flexibility characteristics of a tire would be satisfactory for the network, a tire is shown as preferred and will be referred to herein when discussing the toroidal members.

Figure 1:
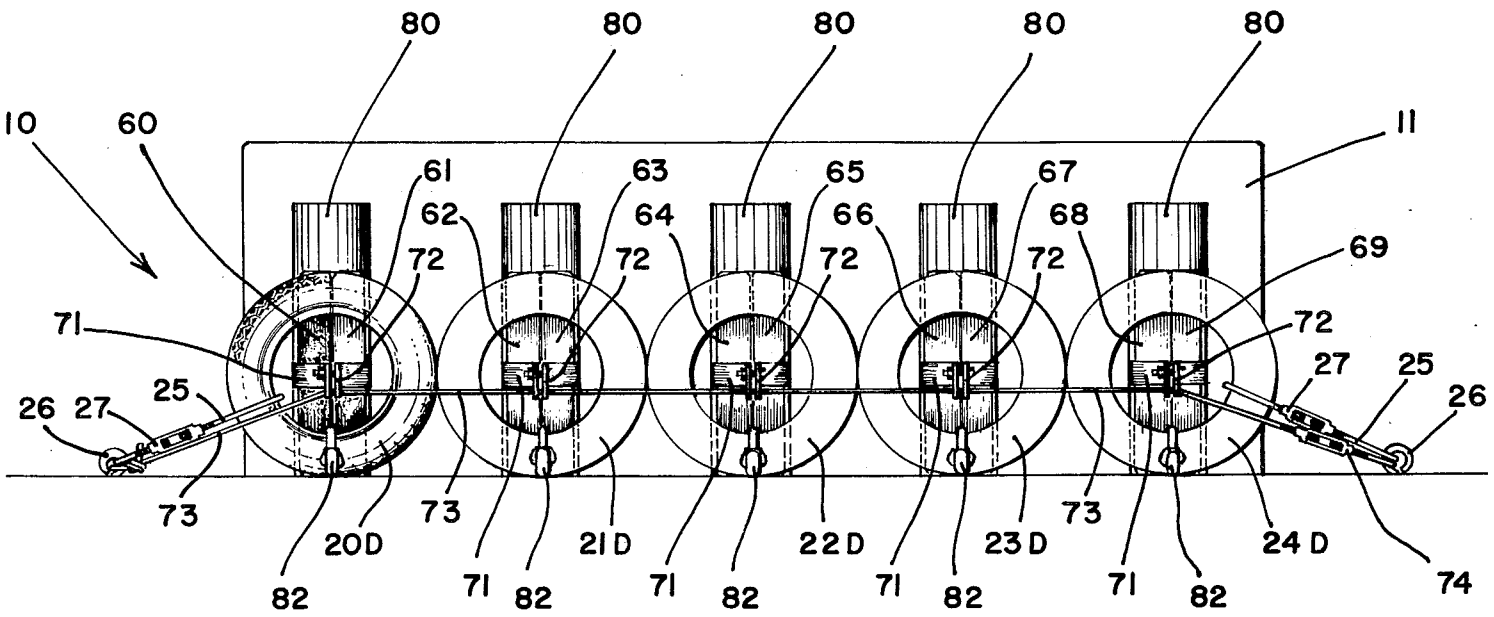
FIG. 1 is a somewhat schematic front elevational view of the barricade constructed according to the preferred concept of the present invention.
Figure 2:
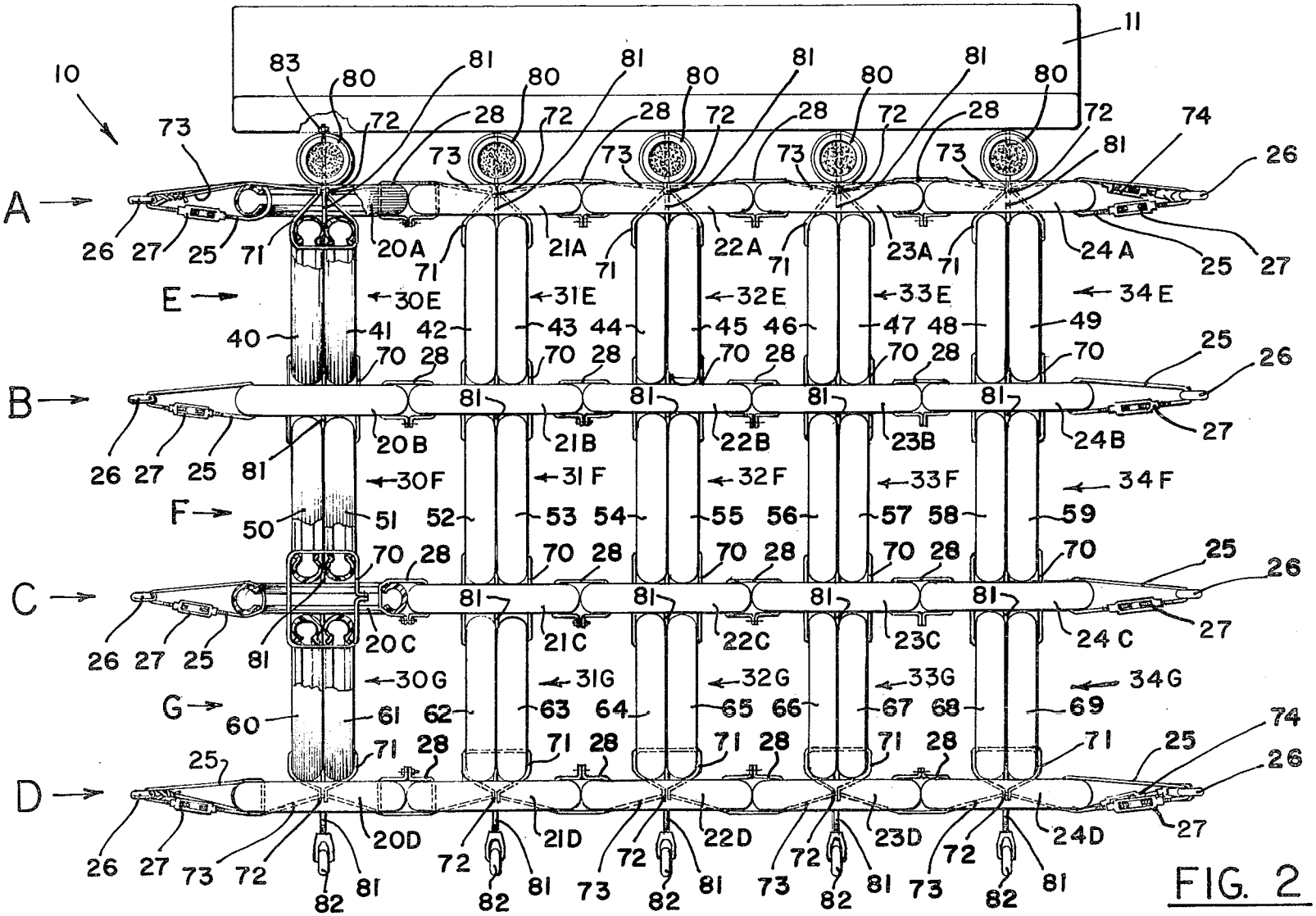
FIG. 2 is a somewhat schematic top plan view of the barricade shown in FIG. 1 having portions thereof broken away for clarity.

The network of tires forming barricade 10 includes a plurality of rows of tires with four such rows being shown and labelled A, B, C and D in FIG. 2. While it is almost essential that there be two rows, the total number of rows is not important to the invention and will vary dependent on numerous conditions such as the type of hazard, the expected speed of the vehicle, the amount of space between the hazard and the roadway, and the like. Each row has a plurality of tires therein with the tires in row A being indicated by the numerals 20A through 24A, the tires in row B being indicated by the numerals 20B through 24B, the tires in row C being indicated by the numerals 20C through 24C and the tires in row D being indicated by the numerals 20D through 24D. Thus, five tires are shown in each row but again this is only by way of example with the exact number of tires along a row varying dependent on the conditions such as previously described. In addition, instead of single tires 20 through 24 in each row, a plurality of adjacent tires could be utilized to form a row if conditions so warranted without departing from the spirit of this invention.

The tires in rows A through D are upright, that is, resting on the outer diameter of their toroid configuration and situated adjacent each other. Each of the rows runs in a direction generally paralleling hazard 11 and therefore usually are situated in planes transverse to the expected direction of any vehicular impact. The first row, row A, is generally adjacent hazard 11 while the last row, in this instance row D, is positioned to receive the contact of the vehicle.

Tires 20A, B, C and D and tires 24A, B, C and D, that is, the outer tires in each row, are held tightly to the ground or other supporting structure by cables 25 extending around the body of each tire and affixed to the ground, as by eye anchors 26. Cables 25 may be maintained in proper tension by turnbuckles 27. Internally of each row, the tires are connected together as by metallic bands 28. Thus, bands 28 connect tires 20 to tires 21, tires 21 to tires 22, tires 22 to tires 23 and tires 23 to tires 24.

The network of tires forming barricade 10 also includes a plurality of lines of tires between each row of tires with three such lines of tires being shown and labelled E, F and G in FIG. 2. There is a line of tires interposed between each row of tires and thus in the preferred form, there will always be one less line then row of tires. Each line of tires includes at least one column interposed between the individual tires of the rows of tires A through D and indicated generally by the numberals 30E through 34E for line E, 30F through 34F for line F and 30G through 34G for line G. Each column consists of one or more tires, there being the same number of columns per line as there are tires in each row. These tires can be upright and are situated between and generally at right angles to the tires of the adjacent rows. Thus, the tires in the columns extend in the longitudinal direction, that is, in a direction and plane generally paralleling the expected vehicular impact. As such, these tires will bear the brunt of the compressive force of any collision.

The columns shown each include two tires and thus each line consists of 10 tires in the network shown, the tires of line E being designated by the numerals 40 through 49, those of line F being designated by the numerals 50 through 59, and those of line G being designated by the numerals 60 through 69.

Unlike the individual tires in rows A, B, C and D, the columns of tires in line E, F and G are not connected to each other. Rather, each column of tires in a line is connected to an adjacent column of tires in the next adjacent line by a metallic band 70. Each band 70 extends around the bodies of the tires of one column, through the center of the tire in the adjacent row of tires and then around the bodies of the pair of tires in the adjacent column in the adjacent line. In this manner, not only are the adjacent lines of tires integrally connected, but also the lines of tires are integrally connected to the internal rows of tires with the toroidal member in each line engaging the toroidal member in each row along a chordal plane thru the torus of the member in a row thereby forming the integral network. By way of specific example, a band 70 entends around the body of tires 40 and 41 of column 30E, through tire 20B and around the body of tires 50 and 51 of column 30F so that columns 30E and 30F are drawn tightly together with tire 20B sandwiched therebetween. Similarly, another band 70 extends around the body of tires 50 and 51 of column 30F, through tire 20C and around the body of tires 60 and 61 of column 30G to draw columns 30F and 30G together with tire 20C therebetween.

The end lines of the network, that is, lines E and G, are connected to the end rows A and D respectively, by metallic bands 71. Each band 71 extends around the bodies of the tires in a column and through the center of a tire in an adjacent end row. A tab 72 is formed in each band 71 having an aperture therethrough. A cable 73 is tautly stretched through the apertures of tabs 72 at each end of the network, tightened by turnbuckles 74 and affixed to eye anchors 26. In this manner all of the columns of tires in line E are attached to the adjacent tires of row A and all of the columns of tires in line G are attached to the adjacent tires in row D.

The integral network of tires just described is capable of uniformly distributing the force of impact from a vehicle no matter where the vehicle contacts the tires along row D. Although the network is tied to the ground at the sides thereof by cables 25, there is a distinct possibility that the center of the network could jump upwardly. While distributing some of the force of the blow vertically is desirable, too much verticle movement of the tires in the network would be undesirable. In order to prevent excessive vertical movement there is provided a plurality of vertical posts or stanchions 80 positiond generally between hazard 11 and the first row, A, of tires. As shown, there is one stanchion 80 for each tire in row A. A cable 81 is affixed to each stanchion 80 and extends through a tire in each row of tires, between the tires forming a column in each line of tires and is fastened to eye anchors 82 at the front of the barricade. The manner in which each cable 81 is affixed to each stanchion 80 is not critical to the invention but it has been shown that each cable extends through an aperture in each stanchion to be affixed at the back thereof, as at 83. Now as a vehicle contacts the barricade, the network will be permitted to "float" somewhat, which is desirable to distribute forces, but any vast degree of vertical movement will be prohibited.

The precise vertical height of the network of tires has not been specifically depicted herein and is unimportant to the concept of the present invention. However, it is important that the height of the network generally coincide with the point at which a vehicle would be expected to strike the barricade. Thus, it is likely that the barricade would be raised off the ground to a certain extent so that the bumper of a vehicle, for example, would strike the tires in row D near the center thereof. Such raising could be accomplished by any suitable means and could even be effected by a plurality of stacked tires resting on the ground upon which the network of tires shown would rest. In addition, for aesthetic purposes, the entire network could be covered with a canvas or plastic material which would in no way deter from the energy absorbing characteristics of the barricade.

While the barricade shown is generally of a rectangular configuration, it should be evident that any configuration could be selected without departing from the spirit of this invention. The configuration selected would of course, depend on the conditions previously described such as the type of hazard being shielded, the expected speed of the vehicle, the space existing between the hazard and the roadway and the like. For example, if desired, a generally triangular shaped network of tires could be created by eliminating tires 20C, 20D, 21D, 23D, 24C, 24D, 50, 51, 58, 59, 60, 61, 62, 63, 66, 67, 68, and 69 from the network shown in FIG. 2.

It should thus be evident that a vehicular energy absorbing traffic barricade constructed according to the concept of the present invention, as described herein, will safely absorb and distribute the energy of the moving vehicle without severe damage to the vehicle, its occupants and the hazard, and without severly endangering other traffic thus substantially improving the traffic safety art and otherwise accomplishing the objects of the present invention.

I claim:

1. Apparatus for absorbing the impact of a collision of a moving vehicle with a hazard comprising, at least two rows of upright adjacent toroidal members extending in planes generally transverse to the expected direction of impact, the first of said rows being generally adjacent the hazard and the last of said rows being positioned to receive the contact of the vehicle, means to connect each said toroidal member in a said row to its adjacent toroidal member in said row, a line of toroidal members between each said row of toroidal members, the toroidal members of said line extending in a direction generally longitudinally of the expected direction of impact and in planes generally parallel thereto, and additional means to connect each said line of toroidal members to it adjacent rows of toroidal members to form an integral network of permanently connected toroidal members to absorb the impact of a collision with a moving vehicle and with the toroidal members in each line engaging the toroidal members in each row along a chordal plane thru the torus.

2. Apparatus according to claim 1 further comprising means to hold down each said row of toroidal members, and means positioned between said first row of toroidal members and the hazard to support said means to hold down each said row of toroidal members.

3. Apparatus according to claim 2 wherein said means positioned between said first row of toroidal members and the hazard includes a plurality of stanchions, and wherein said means to hold down each said row of toroidal members includes means extending from said stanchions and through said toroidal members.

4. Aparatus according to claim 1 wherein said line of toroidal members consists of a plurality of columns of upright toroidal members, said columns positioned generally transverse to adjacent toroidal members of said row of toroidal members.

5. Apparatus according to claim 4 wherein said additional means to connect each said line of toroidal members to its adjacent rows of toroidal members includes band means to connect each said column of one line of toroidal members to an adjacent column in an adjacent line of toroidal members with a toroidal member of the row between said columns therebetween.

6. Apparatus for absorbing the impact of a collision of a moving vehicle with a hazard comprising, at least two rows of upright adjacent toroidal members extending generally transverse to the expected direction of impact, the first of said rows being generally adjacent the hazard and the last of said rows being positioned to receive the contact of the vehicle, a line of toroidal members between each said row of toroidal members, each said line of toroidal members including at least one column of upright toroidal members positioned generally transverse to adjacent toroidal members of said row of toroidal members and extending in a direction generally longitudinally of the expected direction of impact, said column including more than one toroidal member, and means to connect the toroidal members of each said column to each other and to connect each said column to the adjacent toroidal members in adjacent rows of toroidal members.

7. Apparatus according to claim 6 further comprising means to connect each said toroidal member in a said row to its adjacent toroidal member.

8. Apparatus according to claim 7 wherein said means to connect also connects each said column of one line of toroidal members to an adjacent column in an adjacent line of toroidal members with a toroidal member of the row between said columns therebetween.

9. Apparatus according to claim 8 further comprising means to anchor the end toroidal member of each row of toroidal members.

10. Apparatus according to claim 9 further comprising means connecting the columns in said line of toroidal members adjacent said first row of toroidal members to said first row of toroidal members.

11. Apparatus according to claim 10 further comprising means connecting the columns in said line of toroidal members adjacent said last row of toroidal members to said last row of toroidal members.

12. Apparatus according to claim 11 further comprising stanchion means positioned between said first row of toroidal members and the hazard, and means connected to said stanchion means to hold down each said row of toroidal members.

* * * * *